United States Patent [19]

Barkemeyer

[11] 4,221,255

[45] Sep. 9, 1980

[54] DECORATIVE PANEL ASSEMBLY

[76] Inventor: Erica C. Barkemeyer, 1695 Dominion Dr., Akron, Ohio 44313

[21] Appl. No.: 904,787

[22] Filed: May 11, 1978

[51] Int. Cl.[2] ..... E05D 15/06

[52] U.S. Cl. ..... 160/197; 160/38

[58] Field of Search ..... 160/19, 38, 39, 135, 160/197, 202, 327, 351; 24/67.9, 67.11, 85 R, 85 B, 85 C

[56] References Cited

U.S. PATENT DOCUMENTS

| | | | |
|---|---|---|---|
| 2,208,722 | 7/1940 | Doty | 24/85 B |
| 2,708,711 | 5/1955 | McGinty et al. | 160/19 |
| 2,998,062 | 8/1961 | Bixby | 160/39 |
| 3,007,036 | 10/1961 | Mills, Jr. | 160/38 |
| 3,223,146 | 12/1965 | Wessels et al. | 160/38 |
| 3,297,075 | 1/1967 | Howell et al. | 160/19 |
| 3,348,603 | 10/1967 | Ford | 160/202 |
| 3,601,353 | 8/1971 | Dale | 160/327 |
| 3,895,670 | 7/1975 | Bales et al. | 160/135 |
| 3,911,991 | 10/1975 | Malferrari | 160/202 |

*Primary Examiner*—Peter M. Caun

*Attorney, Agent, or Firm*—Oldham, Oldham, Hudak & Weber

[57] ABSTRACT

A decorative panel assembly wherein a valance board receives and maintains a plurality of tracks, the tracks receiving rollers connected to decorative panels. The panels and valance board are provided with edge clamps, acting as mouldings, or used for securing decorative coverings thereto. A first source of illumination is provided in the valance board and in front of the panels to cast light upon the same. A second light source is vertically positioned behind the end panels for creating an indirect lighting or ghosting effect. A spring-biased curtain rod holder may be maintained within the valance board and behind the panels, if so desired.

3 Claims, 7 Drawing Figures

DECORATIVE PANEL ASSEMBLY

BACKGROUND OF THE INVENTION

Heretofore in the decorating art, numerous approaches have been taken to provide appealing window coverings, room dividers, and the like. In recent years, draperies have become too conventional and costly for the changing tastes of a young society and the same have given way to more modern devices such as shutters, window shades, and small-slat Venetian blinds. However, these devices are complex and costly, and generally of a fixed nature, not readily adapted to change to accomodate an alternative room decor.

U.S. Pat. No. 3,348,603, presents a decorative panel assembly wherein a plurality of panels are maintained by carriers upon an elongated track. Such a structure provides a different approach to window coverings and room dividers, but it is of a fixed decorative nature. Such a device does not allow the panels to slide easily, and the friction of the carriers upon the tracks restricts movement of the panels. Further, this patent teaches a track which is totally exposed, with no provision for a decorative valance or the like to conceal the tracks.

In the prior art, there are no known decorative panel assemblies wherein both direct and indirect lighting effects may be provided in conjunction with a valance board assembly to obtain a desired illumination or ghosting effect. Yet further, there are no known decorative panel assemblies which include a curtain rod holder which may be secured within the valance board and behind the panels to maintain curtain, if such is desired. Yet further, there are no known decorative panel assemblies which offer to a young society the tools of self expression available through contemporary materials.

OBJECTS OF THE INVENTION

In light of the foregoing, it is an object of the instant invention to provide a decorative panel assembly which is easily decorated and redecorated to accommodate changes in room decor.

Yet another object of the invention is to provide a decorative panel assembly which includes sources of both direct and indirect illumination of the decorative panels.

Yet another object of the invention is to provide a decorative panel assembly which includes a valance board maintaining therein tracks, light sources, curtain rod holders, and the like, and which may, itself, be quickly and easily decorated.

Still another object of the invention is to provide a decorative panel assembly which may be used either as a window covering, wall treatment, or room divider with only slight modifications being necessary to the valance board.

An additional object of the invention is to provide a decorative panel assembly which has a significant insulating effect when used as a window covering.

Yet another object of the invention is to provide a decorative panel assembly which is inexpensive to construct, attractive in appearance, simply to use and install, and readily constructed from state-of-the-art components.

SUMMARY OF THE INVENTION

The foregoing objects and other objects of the invention which will become apparent as the detailed description proceeds are achieved by a decorative panel assembly, comprising: a valance, a plurality of tracks maintained within said valance; a plurality of panels maintained and movable upon said tracks, said panels including removable resilient edge mouldings securing decorative materials to said panels.

DESCRIPTION OF THE DRAWINGS

For a complete understanding of the objects and structure of the invention, reference should be had to the following detailed description and accompanying drawings wherein.

DETAILED DESCRIPTION OF THE PREFERRED EMBODIMENT

Figure 1:
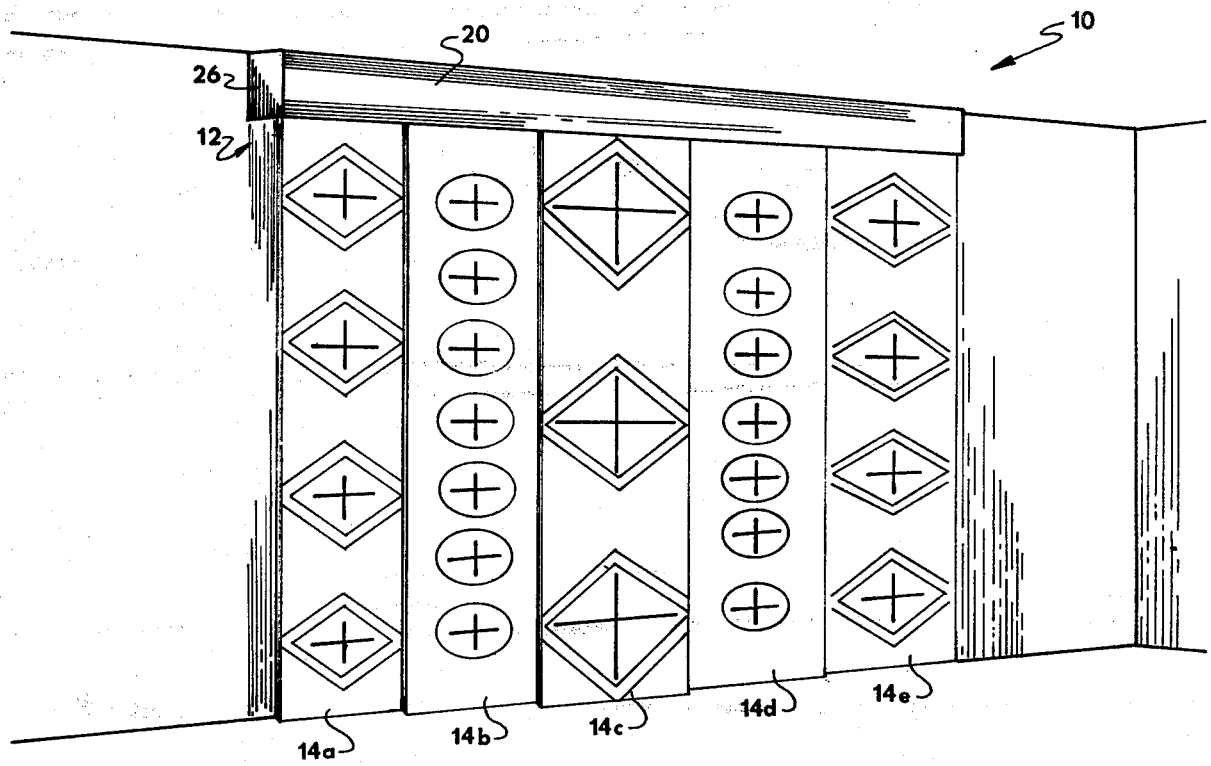
FIG. 1 is a pictorial illustration of the decorative panel assembly of the invention.

Referrring now to the drawings, and more particularly FIG. 1, it can be seen that the decorative panel assembly of the invention is designated generally by the numeral 10. A valance board 12 is fixedly secured to the ceiling and maintains therein means for securing panels 14*a*–14*e*. As shown in FIG. 1, these panels are of a decorative nature, and may be covered by wallpaper, vinyl wall-covering, natural fiber, leather, cloth, paint, or the like. The panels are movable upon tracks maintained within the valance board 12 to open and expose the window when used as a window covering.

Figure 3:
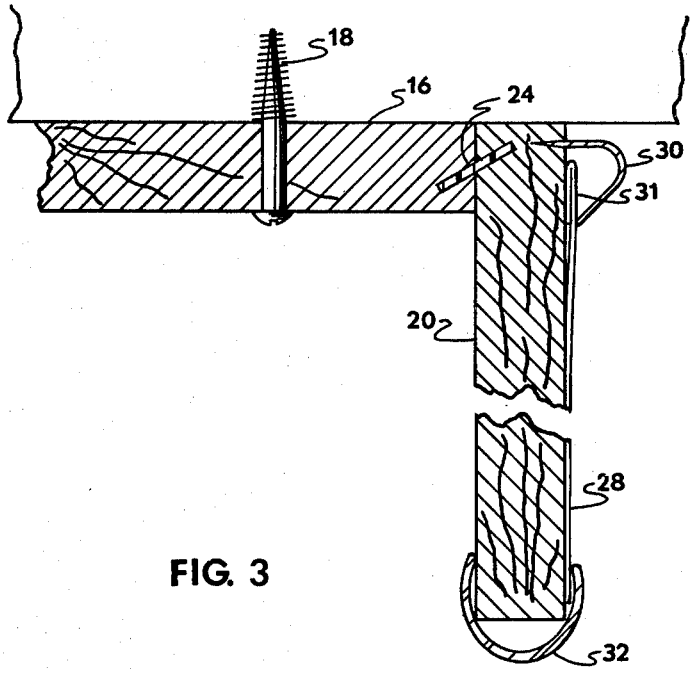
FIG. 3 is a sectional end view of the valance board of the invention.
Figure 2:
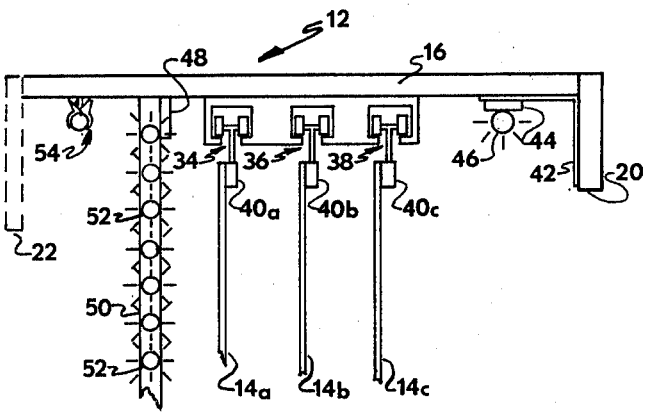
FIG. 2 is an illustrative end view of the decorative panel assembly as shown in FIG. 1.

With continued reference to FIG. 1, and particular reference to FIGS. 2 and 3, it can be seen that the valance 12 includes a ceiling board 16 which may be secured to the ceiling by means of appropriate fasteners such as screws 18. Connected to the ceiling board 16 is a front board 20 and, if the assembly 10 is to be used as a room divider, a rear board 22 may be included. The boards 20,22 are secured to the ceiling board 16 by means of a plate or pins 24 maintained in complementary angled slots provided between the ceiling board 16 and front and rear boards 20,22. It will be understood that the valance 12 may be easily assembled by placing a dowel pin or plate 24 into the slots maintained within the ceiling board 16 and then sliding the mating slots of the boards 20,22 thereonto. As shown in FIG. 1, end boards 26 are also included and may be secured to the ceiling board 16 in a similar manner.

In FIG. 3, a wallpaper, vinyl wall-covering, cloth, or other decorative material is shown placed over the boards 20,22,26, and secured thereto by means of resilient clips 30,32. The top clip 30 is received within a longitudinal slot provided in the boards 20,22,26, to secure a top edge of the material 28. The resilient clip 32 merely snaps around the bottom edge of the board to secure the bottom of that material. Of course, if the boards 20,22,26 were merely to be painted, the clips 30,32 could still be used to provide the effect of moulding on the valance 12. Further, while the clips 30,32 may be of any suitable nature, it is preferred that the same are of a molded plastic or thin metal to maintain a resilient nature to achieve the desired securing effect. Of course, to enhance the securing of the top portion of the material 28, the same may be folded as at 31.

With specific reference to FIG. 2, it can be seen that a plurality of tracks 34,36,38 are maintained within the valance board 12 and secured to the ceiling board 16. These tracks receive the panels 14 *a*–14*e*; the panels 14*a*–14*c* being seen from the end view shown in FIG. 2. While the tracks 34 will be described in more detail hereinafter, suffice it to say that such tracks provide mobility to the panels by means of rollers riding therewithin. In the preferred embodiment of the invention, the end panels 14*a* and 14*e*, shown in FIG. 1, are fixedly secured by a hook or the like such that, even though the same are shown on rollers and tracks, they are stationary and do not move. Only the panels 14*b*–14*d* are movable, and the same may be opened to expose the area defined by the panels 14*a* and 14*e*. In any event, the panels are connected to the track assemblies 34–38 by means of gliders 40*a*–40*c*, which comprise small strips, the width of the associated panel, and having attached thereto, appropriate connecting means for removably securing the panel. In the preferred embodiment of the invention, the gliders 40*a*–40*c* may be constructed of a plastic, wood, metal, or similar material, and have attached thereto a portion of a hook and loop securing means. The mating portion of the hook and loop apparatus is secured to the top edge of the associated panel 14*a*–14*c*. Such structure provides for quick and simple engagement and disengagement of the panel with the track assembly for redecorating or cleaning purposes.

In the preferred embodiment of the invention, a reflective covering or coating 42 is provided as shown in FIG. 2 along the corner defined by the intersection of the ceiling board 16 and the front board 20. This reflective material could simply be a foil, paint, coating, or the like. Secured to this reflective material is a light strip 44, having a plurality of lamps 46 maintained in spaced relationship therealong. When illuminated, the lamps 46 cast both direct light and light reflected from the surface 42 onto the various decorative panels 14*a*–14*e* for an appealing illuminated effect.

Positioned along the outside vertical edge of the fixed panels 14*a* and 14*e* is a vertical light strip 50 having a plurality of spaced lamps 52 maintained thereon. The strip 50 may be secured to the plate 48 by means of a hook and loop engagement. The plate 48 may be fastened by means of nails, screws, or the like to the ceiling board 16, although it is equally contemplated that the plate 48 could be maintained on a track for mobility. In any event, with the lamps 52 vertically spaced behind the outside edges of the panels 14*a* and 14*e*, an indirect lighting effect is presented from behind the assembly 10 to outline the same with a soft illumination. With the strip 50 being secured by means of the hook and loop engagement at 48, the same may be easily attached or detached dependent upon the desires of the user. It is further contemplated that the lamps 46 and 52 may operate in concert or independently of each other, according to the desires of the user.

Finally, maintained within the valance board 12 is a curtain rod holder 54, which will be elaborated upon hereinafter. Suffice it to say at this time that the curtain rod holder 54 may secure a sheer or other type of curtain or drapery panel behind the panels 14*a*–14*e*, if such is desired. Thus, when the panels 14*b*,14*c* are slid over the panel 14*e*, and the panel 14*d* is slid over the panel 14*e*, the exposed window will still be slightly shaded.

Figure 4:
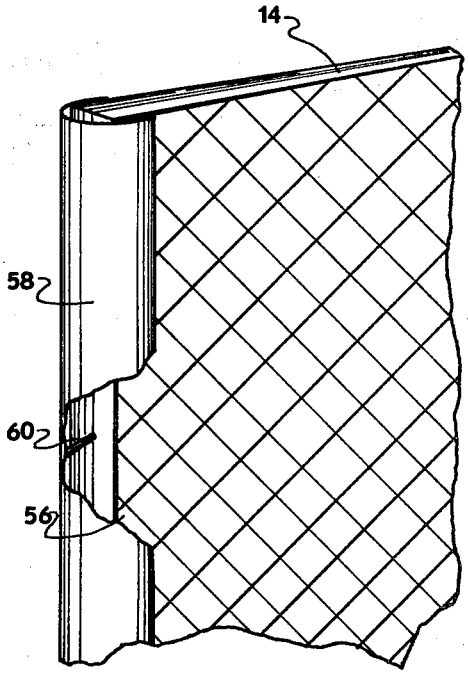
FIG. 4 is a sectional end view of the panel edge clamps used with the panels of the invention.

With reference now to FIG. 4, it will be seen that the panels 14 may be covered by means of paper, vinyl, cloth, or the like 56, secured thereto by means of a resilient clip 58. The panels 14 may be constructed of any suitable material such as particle board, plain or colored translucent acrylic boards, or the like, and need not be covered as with the material 56, but may, alternatively, be painted. In either event, the clip 58 provides an edge mould for the panel 14, serving in the dual capacity of a clip when a covering material 56 is used. Preferably, the clip 58 is of a plastic construction to provide a spring-like grip on the edge of the panel 14, the clip being normally urged to a position such that it firmly grips the board 16. To further provide for secured engagement of the clip 58, and particularly when the same is not of a resilient nature, prongs or other pointed elements 60 may be provided as an integral part of the clip 58 to make piercing secured engagement with the edge of the panel 14.

Figure 5:
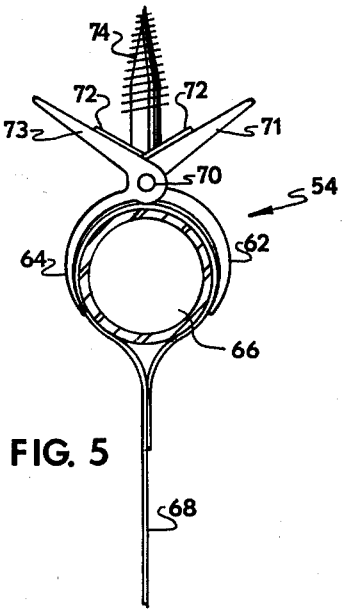
FIG. 5 is a front plan view of the curtain rod holder used with the valance board of the invention.

As mentioned above, included as a portion of the assembly 10 are curtain rod holders 54, shown in detail in FIG. 5. Of course, at least two holders 54 would normally be required, one at each end of the rod, and it is preferred that a third holder 54 be interposed midway along the rod. It will be seen that semicircular members 62,64 are provided for securing a curtain rod 66 which has been slid through the top opening of a curtain 68. Relative movement between the members 62,64 is provided about the pivotal pin 70. Part and parcel of the members 62,64 are respective ears 71,73. These ears are biased by means of a spring 72 interposed therebetween and about the pivotal pin 70. The spring 72 urges the elements 62,64 toward each other into a closed position to secure the rod 66. When the ears 71,73 are squeezed toward each other, the elements 62,64 open to allow easy removal or replacement of the rod 66. A screw or other securing device 74 is provided as part and parcel of the element 54 to secure the same to the ceiling board 16 of the valance 12.

Figure 6:
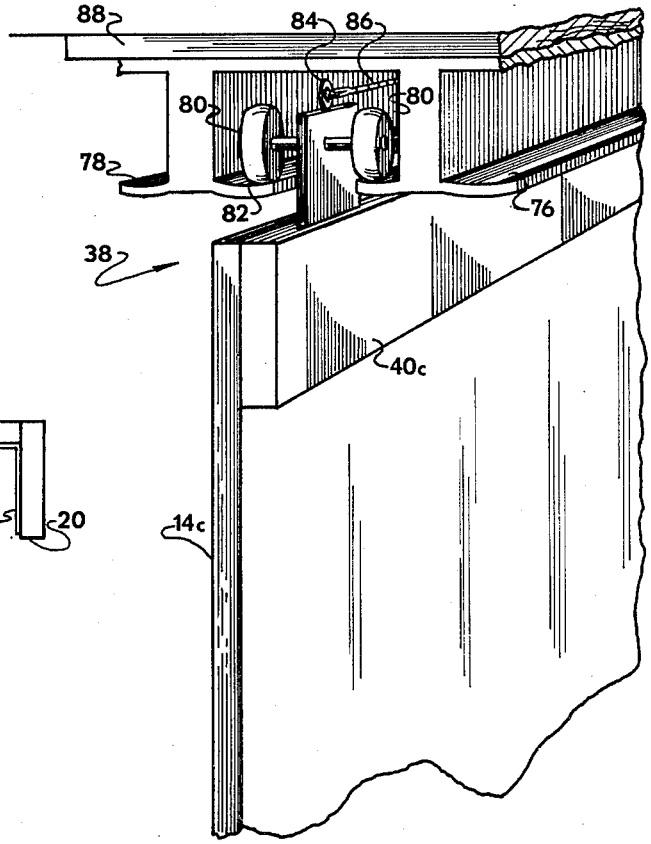
FIG. 6 is a sectional view showing the rollers connected to the panels of the invention and riding upon the tracks thereof.

As shown in FIG. 6, a typical track assembly 38 includes arcuate tracks 76,78 receiving thereupon a pair of wheels 80,80. These wheels may be of any suitable nature, but are preferably of the ball-bearing type to reduce friction and provide easy manipulation of the panels 14. In any event, the wheels 80,80 are attached by means of an axle to a connector 82 which is secured to the glider 40*c*. The connector 82 may either be screwed into the glider 40*c*, molded thereinto, or otherwise appropriately affixed. In any event, an eye 84 is provided as part and parcel of the connector 82 and has affixed thereto a drawcord or string 86, to facilitate movement of the panel 14*c*. The arcuate tracks 75,78, again of plastic or metal construction, are secured to a mounting bracket 88 which is attached to the ceiling board 16 in any appropriate fashion. It should be briefly noted that with the tracks 76,78 being slightly arcuate, a trough is provided wherein the wheels 80,80 may ride.

Figure 7:
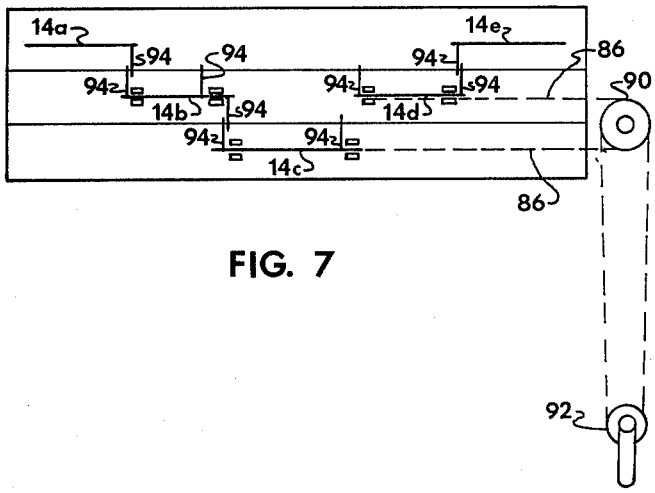
FIG. 7 is an illustrative top view of the track assembly, showing the interrlationships between the various panels.

With final reference to FIG. 7, it can be seen that the cord 86, connected to the lead panels 14*c*,14*d*, passes over a spool 90 and to a pulley 92 to facilitate opening and closing of the panels 14. As has been previously known in the art, the panels may make engagement with each other to facilitate sequential movement of the same by means of stops 94 connected to the associated gliders 40. For example, with the assembly of FIG. 7 in the "open" position, the panel 14*c* may be moved via the cord 86 until its end stop 94 makes engagement with the front stop 94 of the panel 14*b*. Continued movement of the panel 14*c* thus causes a closing movement of the panel 14*b*. This continues until the end stop 94 of the panel 14*b* makes contact with the front stop 94 of the fixed panel 14*a*. At this point, no further movement of the panels 14*b* and 14*c* is possible. Of course, the panels 14*d* and 14*e* function in a similar manner and, when opening the panels, the operation is reversed.

It should now be apparent that there has been presented a decorative panel assembly which is readily changeable to accommodate any decor and utilize contemporary materials. The panel assembly is adaptable for use as a window covering or wall treatment, as well as for a room divider. As a window covering, the panel boards provide an insulating effect not achieved with standard draperies. Illumination, both direct and indirect, has been provided to accommodate the tastes of the user. Yet further, the entire system described may be assembled with a minimum requirement of tools, and quickly and easily disassembled for cleaning or redecorating purposes.

While in accordance with the patent statutes, the foregoing is only the best mode and preferred embodiment of the invention, and it is to be understood that the invention is not limited thereto or thereby. Consequently, for an understanding and appreciation of the true scope and breadth of the invention, reference should be had to the following claims.

What is claimed is:

1. A decorative panel assembly, comprising:

a valance having clips for maintaining decorative material thereon, said clips including a bottom clip secured about a bottom edge of said valance, and a top clip extending along a top edge of said valance and having a first edge received within said valance and a second edge in contacting engagement with said decorative material and securing the same against said valance;

a plurality of tracks maintained within said valance; and a plurality of panels maintained by and movable upon said tracks, said panels including removable resilient edge mouldings securing decorative materials to said panels.

2. The decorative panel assembly according to claim 1 wherein said edge mouldings include prongs adapted for piercing engagement with edges of said panels.

3. A decorative panel assembly, comprising:

a valance;

a plurality of tracks maintained within said valance;

a plurality of panels maintained by and movable upon said tracks by rollers, said panels including removable resilient edge moldings securing decorative materials to said panels; and wherein said valance includes means for securing a curtain rod therewithin parallel to said tracks, said means comprising spring biased arcuate elements, pivotal about a common pin and having a screw extending from said pin and away from said arcuate elements.

* * * * *